US012163676B2

(12) United States Patent
Kole et al.

(10) Patent No.: US 12,163,676 B2
(45) Date of Patent: Dec. 10, 2024

(54) NOZZLE ASSEMBLY FOR EXHAUST FAN UNIT OF HVAC SYSTEM

(71) Applicant: Air Distribution Technologies IP, LLC, Milwaukee, WI (US)

(72) Inventors: Anup T. Kole, Dudhgaon (IN); Vikas A. Patil, Jaysingpur (IN); A K S Manian, Chennai (IN); Rajesh D. Vyas, Vadodara (IN); Parmeshwar G. Patil, Pune (IN); Ravindra R. Warake, Gadegaon (IN); Luis L. Vargas, Sachse, TX (US); Atul A. Shitkande, Pune (IN); Kapil D. Sahu, Pune (IN)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 0 days.

(21) Appl. No.: 17/735,039

(22) Filed: May 2, 2022

(65) Prior Publication Data

US 2022/0260089 A1 Aug. 18, 2022

Related U.S. Application Data

(63) Continuation of application No. 16/136,877, filed on Sep. 20, 2018, now Pat. No. 11,320,159.
(Continued)

(51) Int. Cl.
*F24F 11/00* (2018.01)
*F04D 29/44* (2006.01)
(Continued)

(52) U.S. Cl.
CPC ..... *F24F 11/0001* (2013.01); *F04D 29/441* (2013.01); *F23L 17/005* (2013.01);
(Continued)

(58) Field of Classification Search
CPC ..... F24F 7/025; F24F 7/11; F24F 7/74; F24F 2007/001; F04D 29/441; F23L 17/005; F23L 17/14
See application file for complete search history.

(56) References Cited

U.S. PATENT DOCUMENTS 2,188,564 A * 1/1940 Berg ..... F23L 17/02 454/39
6,431,974 B1 8/2002 Tetley et al.
(Continued)

FOREIGN PATENT DOCUMENTS

WO WO-0118324 A1 * 3/2001 ..... F04D 29/663

*Primary Examiner* — Sabbir Hasan
(74) *Attorney, Agent, or Firm* — Michael Best & Friedrich LLP

(57) ABSTRACT

A nozzle assembly for a fan unit includes an inner nozzle having a tapered outer diameter and a flow path radially inward from the tapered outer diameter with respect to a longitudinal axis of the nozzle assembly. The flow path is configured to guide a fluid flow and to expel the fluid flow through an inner outlet of the inner nozzle to a surrounding environment. The nozzle assembly also includes an outer nozzle disposed radially outward from the inner nozzle with respect to the longitudinal axis. The outer nozzle and the tapered outer diameter of the inner nozzle define an annular flow path therebetween. The annular flow path is configured to guide the fluid flow and to expel the fluid flow to the surrounding environment through an outer outlet of the outer nozzle. A cross-sectional area of the outer outlet is adjustable via movement of the inner nozzle, the outer nozzle, or both along the longitudinal axis of the nozzle assembly.

12 Claims, 12 Drawing Sheets

Related U.S. Application Data

(60) Provisional application No. 62/733,426, filed on Sep. 19, 2018.

(51) Int. Cl.

| | |
|---|---|
| ***F23L 17/00*** | (2006.01) |
| ***F23L 17/14*** | (2006.01) |
| ***F24F 7/02*** | (2006.01) |
| ***F24F 7/06*** | (2006.01) |
| ***F24F 11/30*** | (2018.01) |
| ***F24F 11/74*** | (2018.01) |
| *F24F 1/0007* | (2019.01) |
| *F24F 7/00* | (2021.01) |

(52) U.S. Cl.

CPC ..... *F23L 17/14* (2013.01); *F24F 7/025* (2013.01); *F24F 7/065* (2013.01); *F24F 11/30* (2018.01); *F24F 11/74* (2018.01); *F24F 1/0007* (2013.01); *F24F 2007/001* (2013.01)

(56) References Cited

U.S. PATENT DOCUMENTS

| | | | | |
|---|---|---|---|---|
| 7,241,214 | B2 | 7/2007 | Sixsmith | |
| 7,682,231 | B2 * | 3/2010 | Enzenroth | F23L 17/14 110/162 |
| 9,636,722 | B2 | 5/2017 | Enzenroth et al. | |
| 2003/0114098 | A1 | 6/2003 | Hill et al. | |
| 2013/0315729 | A1 * | 11/2013 | Gans | F04D 29/701 415/220 |
| 2014/0286767 | A1 * | 9/2014 | Mornan | F04D 29/541 415/202 |
| 2016/0327292 | A1 * | 11/2016 | Gans | F23L 17/005 |

* cited by examiner

NOZZLE ASSEMBLY FOR EXHAUST FAN UNIT OF HVAC SYSTEM

CROSS REFERENCE TO RELATED APPLICATIONS

This application is a continuation of U.S. patent application Ser. No. 16/136,877, entitled "NOZZLE ASSEMBLY FOR EXHAUST FAN UNIT OF HVAC SYSTEM," filed Sep. 20, 2018, which claims priority to and the benefit of U.S. Provisional Application Ser. No. 62/733,426, entitled "NOZZLE ASSEMBLY FOR EXHAUST FAN UNIT OF HVAC SYSTEM," filed Sep. 19, 2018, which are hereby incorporated by reference in their entireties for all purposes.

BACKGROUND

The present disclosure relates generally to heating, ventilation, and/or air conditioning (HVAC) systems and, more particularly, to a nozzle assembly of an exhaust fan unit of the HVAC system.

A wide range of applications exist for HVAC systems. For example, residential, light commercial, commercial, and industrial systems are used to control temperatures and air quality in residences and buildings. In certain HVAC systems, exhaust fumes of the HVAC system, or from a space being conditioned by the HVAC system, are expelled to a surrounding environment via an exhaust fan unit. Traditional exhaust fan units may be inefficient and/or ineffective in adequately distributing the exhaust fumes through the surrounding environment. Instead, traditional exhaust fan units may consume excess power and/or may deposit contents of the exhaust fumes in small, concentrated areas of the surrounding environment.

It is now recognized that improved distribution of the exhaust fumes and contents thereof throughout the surrounding environment may reduce power consumption and may improve operation of the HVAC system in other manners. Thus, it is now recognized that improved exhaust fan units are desired.

SUMMARY

The present disclosure relates to a nozzle assembly for a fan unit. The nozzle assembly includes an inner nozzle having a tapered outer diameter and a flow path radially inward from the tapered outer diameter with respect to a longitudinal axis of the nozzle assembly. The flow path is configured to guide a fluid flow and to expel the fluid flow through an inner outlet of the inner nozzle to a surrounding environment. The nozzle assembly also includes an outer nozzle disposed radially outward from the inner nozzle with respect to the longitudinal axis. The outer nozzle and the tapered outer diameter of the inner nozzle define an annular flow path therebetween. The annular flow path is configured to guide the fluid flow and to expel the fluid flow to the surrounding environment through an outer outlet of the outer nozzle. A cross-sectional area of the outer outlet is adjustable via movement of the inner nozzle, the outer nozzle, or both along the longitudinal axis of the nozzle assembly.

The present disclosure also relates to an exhaust fan unit having a base and a nozzle assembly. The nozzle assembly is configured to receive a fluid flow from the base and to expel the fluid flow to a surrounding environment. The nozzle assembly includes an inner nozzle and an outer nozzle disposed radially outward from the inner nozzle with respect to a longitudinal axis of the nozzle assembly. The inner nozzle includes a tapered outer surface decreasing in diameter from an inlet of the inner nozzle to an outlet of the inner nozzle. An annular flow path is defined between the outer nozzle and the tapered outer surface of the inner nozzle, and a cross-sectional area of an outer outlet of the outer nozzle is adjustable via axial movement of the outer nozzle, the inner nozzle, or both along the longitudinal axis of the nozzle assembly, and relative to the base of the exhaust fan unit.

The present disclosure also relates to a fan unit having a nozzle assembly. The nozzle assembly includes an inner nozzle having a tapered outer diameter and a flow path configured to guide a fluid flow and to expel the fluid flow to a surrounding environment. The nozzle assembly also includes an outer nozzle having an outer outlet. The outer nozzle is configured to be disposed about the tapered outer diameter of the inner nozzle with respect to a longitudinal axis of the inner nozzle. The outer nozzle and the tapered outer diameter of the inner nozzle are configured to define an annular flow path therebetween to guide the fluid flow and expel the fluid flow to the surrounding environment through the outer outlet of the outer nozzle. The nozzle assembly also includes an actuator configured to move the inner nozzle, the outer nozzle, or both between a number of axial positions along the longitudinal axis, in order to adjust a cross-sectional area of the outer outlet of the outer nozzle.

DETAILED DESCRIPTION

Figure 1:
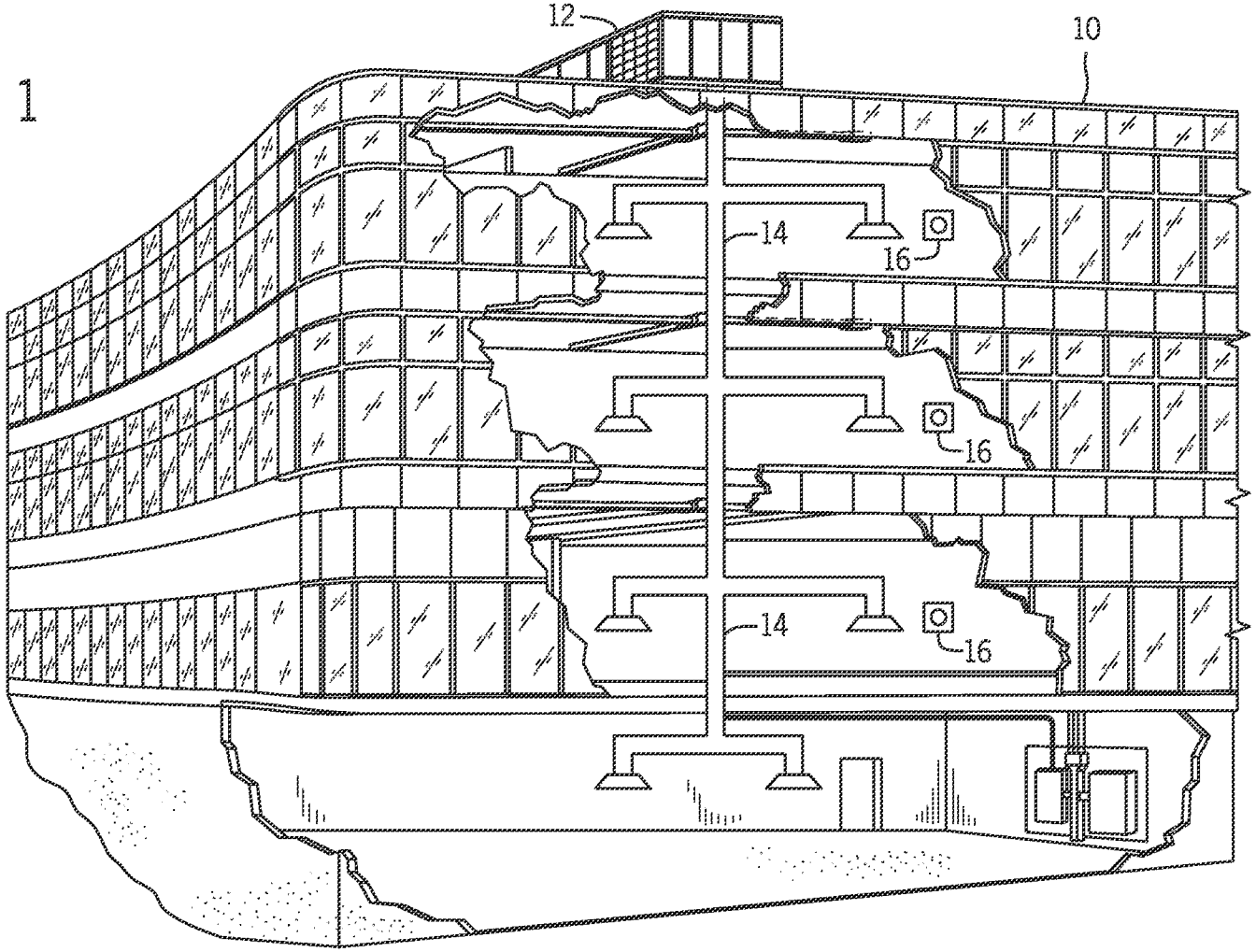
FIG. 1 is a perspective view of a heating, ventilation, and/or air conditioning (HVAC) system for building environmental management, in accordance with embodiments described herein.

The present disclosure is directed toward heating, ventilation, and/or air conditioning (HVAC) systems and, more particularly, toward a nozzle assembly of a fan unit, such as an exhaust fan unit, of the HVAC system.

A wide range of applications exist for HVAC systems. For example, residential, light commercial, commercial, and industrial systems are used to control temperatures and air quality in residences and buildings. In certain HVAC systems, exhaust fumes of the HVAC system, or from the space being conditioned by the HVAC system, are expelled to a surrounding environment via a fan unit, such as an exhaust fan unit. Traditional exhaust fan units may be deficient in efficiently and effectively distributing the exhaust fumes through the surrounding environment, and may instead deposit contents of the exhaust fumes in small or concentrated areas of the surrounding environment.

In accordance with present embodiments, a nozzle assembly of an exhaust fan unit may guide a fluid flow therethrough, such as exhaust fumes of an HVAC system or of a space being conditioned by the HVAC system. The nozzle assembly may be configured to expel or eject the exhaust fumes and distribute the exhaust fumes throughout the surrounding environment. For example, the nozzle assembly may include nested nozzles which are adjustable to select flow path features, such as nozzle outlet area(s), of the nozzle assembly suitable for distribution of the exhaust fumes and contents thereof within the surrounding environment. The nozzle assembly may be adjusted in response to data feedback indicative of operating conditions, such as exhaust demand, of the HVAC system or the space being conditioned by the HVAC system.

For example, the nozzle assembly may include an inner nozzle having a flow path radially inward from the inner nozzle, with respect to a longitudinal axis of the nozzle assembly, and extending along the longitudinal axis. The flow path, referred to in certain embodiments as an inner flow path, is configured to guide the exhaust fumes and to expel the exhaust fumes through an inner outlet of the inner nozzle to the surrounding environment. The inner nozzle may also include a tapered outer diameter, such that the inner nozzle includes a frustro-conical shape along an outer surface of the inner nozzle, whereby the inner outlet of the inner nozzle includes a smaller area or diameter than an inlet of the inner nozzle. In other words, the outer surface of the inner nozzle may include a taper such that an outer diameter of the inner nozzle decreases from the inlet of the inner nozzle toward the inner outlet of the inner nozzle.

The nozzle assembly may also include an outer nozzle disposed radially outward from the tapered outer surface of the inner nozzle, with respect to the longitudinal axis. The outer nozzle and the tapered outer surface of the inner nozzle may define an annular flow path therebetween, where the annular flow path is configured to guide the exhaust fumes and to expel the exhaust fumes to the surrounding environment through an outer outlet of the outer nozzle. That is, the inner outlet of the inner nozzle and the outer outlet of the outer nozzle may each expel the fluid flow, such as exhaust fume flow, from the nozzle assembly and to the surrounding environment.

A cross-sectional area of the outer outlet may be adjustable via movement of the inner nozzle, the outer nozzle, or both along the longitudinal axis of the nozzle assembly. For example, in one embodiment, the inner nozzle is connected to a base of the exhaust fan unit via a stabilizing leg, and the outer nozzle is coupled to the base or to the inner nozzle via an actuator, whereby the actuator facilitates axial movement, along the longitudinal axis, of the outer nozzle relative to the inner nozzle and/or the base. Other actuation mechanisms are also possible for moving the outer nozzle relative to the inner nozzle and/or the base. Additionally or alternatively, the inner nozzle may be coupled to an actuator which facilitates movement of the inner nozzle relative to the outer nozzle and/or the base. By adjusting the respective positions of certain components of the nozzle assembly in response to operating conditions, such as exhaust demand, distribution of the fumes is enhanced via improved fluid velocity, and power consumption of the fan unit is reduced. These and other features will be described in detail below with reference to the drawings.

Turning now to the drawings, FIG. 1 illustrates a heating, ventilation, and/or air conditioning (HVAC) system for building environmental management that may employ an HVAC unit. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single packaged unit containing other equipment, such as a blower, integrated air handler, and/or auxiliary heating unit.

The HVAC unit 12 may be an air cooled device that provides conditioned air to the building 10. Specifically, the HVAC unit 12 may include heat exchanger coils across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may provide both heating and cooling to the building, such that the HVAC unit 12 operates in different modes.

A control device 16, one type of which may be a thermostat, may be used to designate the temperature of the conditioned air. The control device 16 also may be used to control the flow of air through the ductwork 14. For example, the control device 16 may be used to regulate operation of a component of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

In some embodiments, the HVAC unit 12 or a separate HVAC unit of the building 10 may include a furnace. The furnace may include a combustion chamber which combusts an air-fuel mixture to generate hot combustion gases. The hot combustion gases may be passed through a heat exchange coil, and a fan or blower may urge an air flow over the heat exchange coil. Accordingly, the air flow may extract heat from the hot combustion gases, and the hot combustion gases may be subsequently vented to a surrounding environment. In accordance with present embodiments, a vent pipe may be utilized to vent the used combustion gases to the external environment. A vent cap assembly may be disposed on the vent pipe to enable venting of the combustion gases while blocking moisture/liquids, such as rain, debris, or other external elements from entering the pipe.

It should be appreciated that any of the features described herein may be incorporated with the HVAC unit 12, a residential heating and cooling system, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications. In particular, the presently disclosed nozzle assembly and corresponding fan unit may be advantageous for laboratory exhaust fan applications, including chemical and/or biological laboratories. That is, certain laboratory exhaust fan products may be required to meet performance and/or structural criteria associated with the ANSI Z9.5 standard. The disclosed nozzle assembly may be designed, for example, to facilitate a minimum outlet velocity of 3000 feet per minute for flue gases expelled from the nozzle assembly. Indeed, the laboratory exhaust fan unit may include an adjustable nozzle assembly configured to be adjusted, for example in response to an exhaust demand, to expel the exhaust fumes at the required velocity and adequately distribute the exhaust fumes throughout an environment surrounding the exhaust fan unit. By adjusting the nozzle assembly in response to the exhaust demand, outlet velocity can be controlled and distribution of the exhaust fumes and corresponding contents is improved, which may improve operation of the HVAC unit 12. For example, power consumption by the exhaust fan unit and HVAC unit 12 may be reduced. These and other features will be described in detail below with reference to the drawings.

Figure 2:
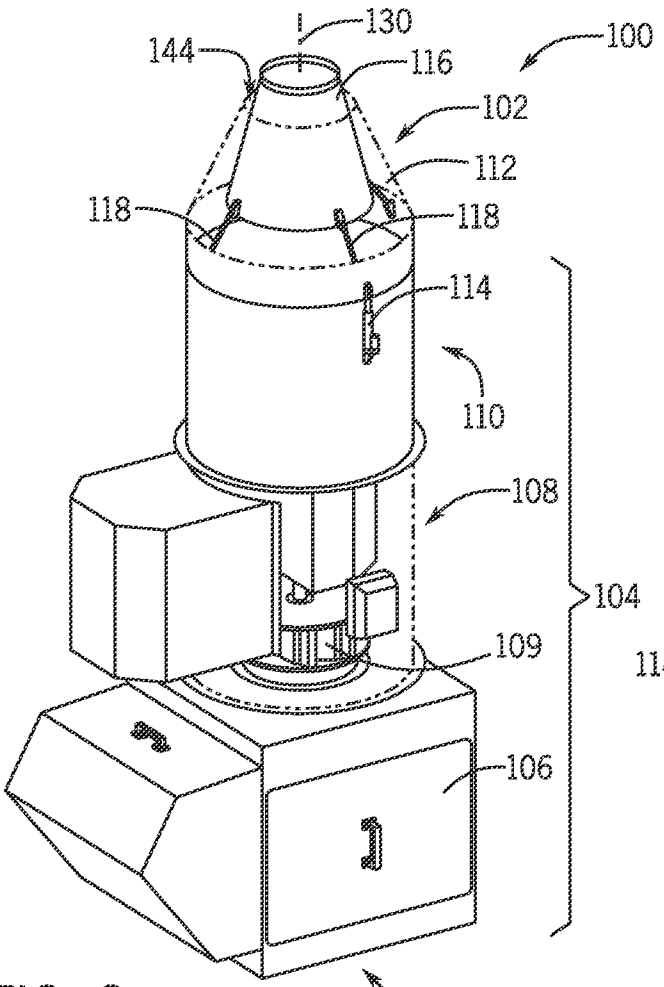
FIG. 2 is a perspective view of an exhaust fan unit for use in the HVAC system of FIG. 1, in accordance with embodiments described herein.

FIG. 2 is a perspective view of an embodiment of an exhaust fan unit 100 for use in the HVAC system of FIG. 1 or other HVAC system. In the illustrated embodiment, the exhaust fan unit 100 includes a nozzle assembly 102 coupled to a base 104, where the nozzle assembly 102 is configured to be adjusted relative to the base 104 to improve expulsion of exhaust fumes from the exhaust fan unit 100.

For example, the base 104 includes a plenum 106, a fan assembly 108 disposed above the plenum 106, and an extender tube 110 disposed above the fan assembly 108. However, the base 104 may include fewer or more components disposed in various arrangements, in other embodiments. A impeller 109 is disposed within the fan assembly 108 and is fluidly coupled with the plenum 106 and the extender tube 110. The extender tube 110 is also fluidly coupled with the nozzle assembly 102. The impeller 109 is configured to draw a fluid, such as exhaust fumes, into the fan assembly 108 via the plenum 106, which is fluidly coupled to a duct inlet 120 of the exhaust fan unit 100. Thus, in the illustrated embodiment, the impeller 109 is configured to draw the fluid through the duct inlet 120, for example from an HVAC duct coupled to the duct inlet 120, through the plenum 106, and into the fan assembly 108. As the fluid passes through the impeller 109 disposed in the fan assembly 108, the impeller 109 may urge the fluid through the extender tube 110 and into the nozzle assembly 102.

The nozzle assembly 102 in the illustrated embodiment includes an outer nozzle 112 coupled to the extender tube 110 of the base 104 via at least one actuator 114 and an inner nozzle 116 coupled to the extender tube 110 of the base 104 via at least one stabilizing leg 118. The actuator 114 may be a hydraulic, pneumatic, electric, or electro-mechanical actuator, or any other suitable actuator configured to move the outer nozzle 112. As the actuator 114 is controlled to move, for example, the outer nozzle 112 relative to the inner nozzle 116 in an axial direction along a longitudinal axis 130 of the nozzle assembly 102, an outer outlet 144 formed between the outer nozzle 112 and the inner nozzle 116 changes in size. For example, if the outer nozzle 112 is moved upwardly along the longitudinal axis 130 and beyond a tip of the inner nozzle 116, the outer outlet 144 forms a maximum outer outlet size and defines a continuous circle or circular cross-section that is uninterrupted by the inner nozzle 116. In other words, the maximum outer outlet size corresponds to a relative positioning of the outer nozzle 112 and the inner nozzle 116 such that the inner nozzle 116 does not intersect the outer outlet 144 of the outer nozzle 112. If the outer nozzle 112 is moved back downwardly along the longitudinal axis 130, a rim of the outer nozzle 112 may come in close proximity to the inner nozzle 116. That is, the inner nozzle 116 may intersect the outer outlet 144 of the outer nozzle 112. When the inner nozzle 116 intersects the outer outlet 144 of the outer nozzle 112, the outer outlet 144 may include an intermediate or minimum outer outlet size. These and other features will be described in detail below.

Figure 3:
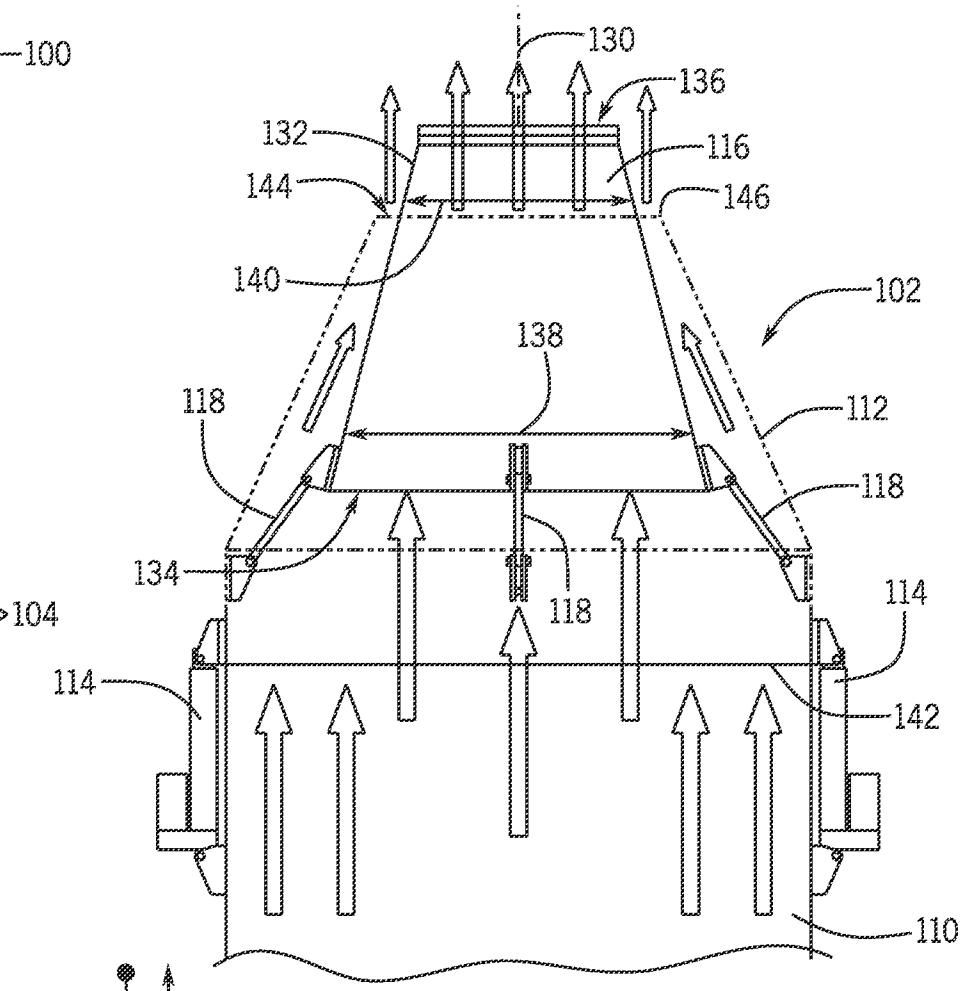
FIG. 3 is a front view of a nozzle assembly of the exhaust fan unit of FIG. 2, in accordance with embodiments described herein.
Figure 4:
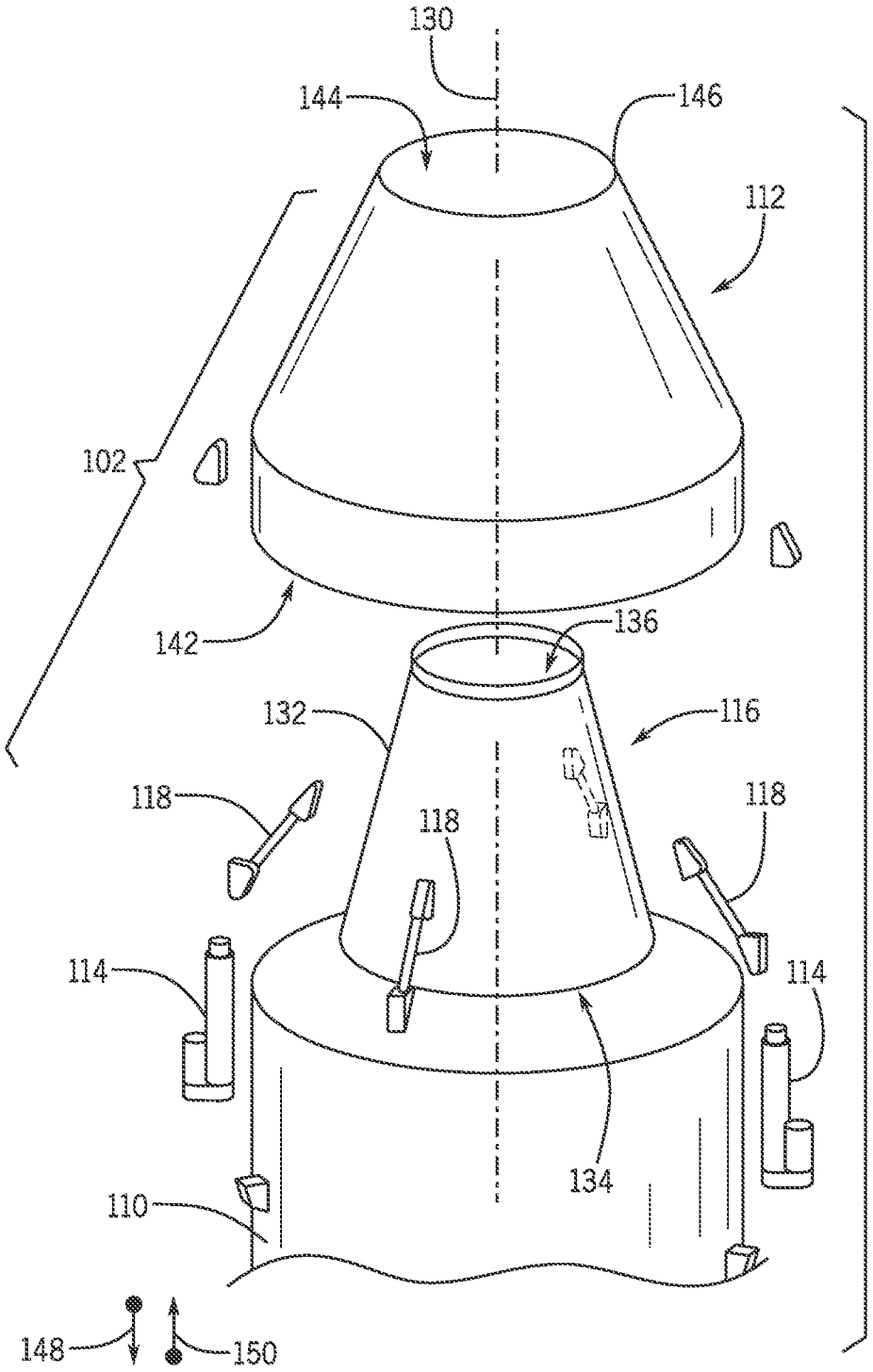
FIG. 4 is an exploded perspective view of the nozzle assembly of FIG. 3, in accordance with embodiments described herein.

FIG. 3 is a front view of an embodiment of the nozzle assembly 102 of the exhaust fan unit 100 of FIG. 2, and FIG. 4 is an exploded perspective view of the nozzle assembly 102 of FIG. 3. In the illustrated embodiments, the nozzle assembly 102 includes the inner nozzle 116 and the outer nozzle 112 disposed radially outward, with respect to the longitudinal axis 130 of the nozzle assembly 102, from the inner nozzle 116. The inner nozzle 116 includes a tapered outer surface 132. The tapered outer surface 132 is tapered toward the longitudinal axis 130 starting from an inner inlet 134 of the inner nozzle 116 and ending at an inner outlet 136 of the inner nozzle 116. In other words, an outer diameter of the inner nozzle 116 decreases from the inner inlet 134 toward the inner outlet 136. For example, focusing on the embodiment illustrated in FIG. 3, an outlet-adjacent outer diameter 138 of the inner nozzle 116 is greater than an inlet-adjacent outer diameter 140 of the inner nozzle 116.

The outer nozzle 112 also includes an outer inlet 142 and the aforementioned outer outlet 144. The outer inlet 142 of the outer nozzle 112 and the inner inlet 134 of the inner nozzle 116 may receive the fluid, for example exhaust fumes, from the extender tube 110 of the base 104, as previously described. The outer outlet 144 of the outer nozzle 112 and the inner outlet 136 of the inner nozzle 116 may expel the fluid, for example the exhaust fumes, from the nozzle assembly 102, as previously described.

An outer rim 146 of the outer nozzle 112 may at least partially define the outer outlet 144. Focusing on FIG. 3, in the illustrated embodiment, the outer outlet 144 is defined between the outer rim 146 of the outer nozzle 112 and the tapered outer surface 132 of the inner nozzle 116. The outer nozzle 112 may be configured to move, for example via employment of the illustrated actuators 114, in an axial direction along the longitudinal axis 130 of the nozzle assembly 102. Thus, as the outer nozzle 112 is moved relative to the inner nozzle 116 in a downward direction 148 along the longitudinal axis 130, a size or cross-sectional area of the outer outlet 144 is reduced as the outer rim 146 boundary of the outer outlet 144 radially approaches the tapered outer surface 132 of the inner nozzle 116.

As the outer nozzle 112 is moved relative to the inner nozzle 116 and in an upward direction 150 along the longitudinal axis 130, the outer rim 146 boundary of the outer outlet 144 radially separates from the tapered outer surface 132 of the inner nozzle 116. In some embodiments, the outer nozzle 112 may be moved in the upward direction 150 along the longitudinal axis 130 such that the corresponding outer rim 146 and outer outlet 144 are disposed above the inner outlet 136 of the inner nozzle 116. In such a position, the outer outlet 144 may be a continuous circular cross-sectional area disposed above the inner outlet 136, which is also circular. Various positions of the nozzle assembly 102 are described in detail below with reference to later drawings.

Figure 5:
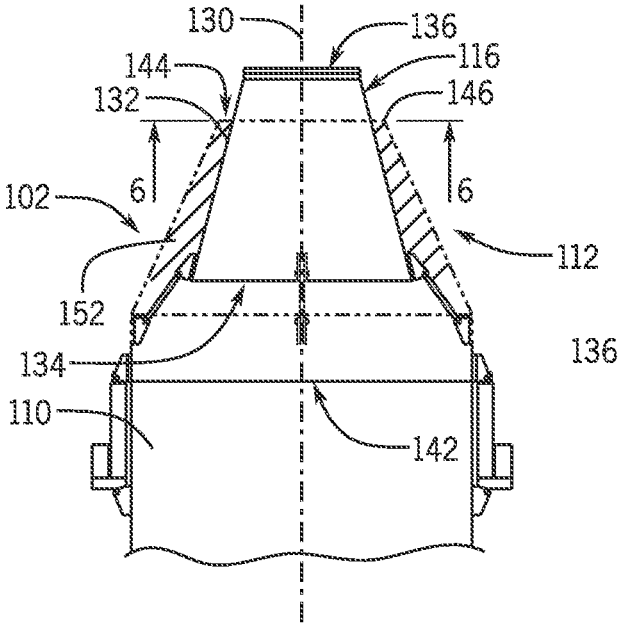
FIG. 5 is a cross-sectional side view of the nozzle assembly of FIG. 3, in accordance with embodiments described herein.

FIGS. 5-8 illustrate an embodiment of the nozzle assembly 102 of FIG. 3 adjusted to a minimum outlet area and, more specifically, a minimum outer outlet 144 area. It should be noted that the minimum outlet area illustrated in FIGS. 5-8 is for descriptive purposes only and, in another embodiment, the minimum outlet area may be less than or greater than the minimum outlet area shown in FIGS. 5-8. In general, the minimum outlet area may correspond to a condition in which the outer rim 146 of the outer nozzle 112, as illustrated in FIG. 5, is as close to the tapered outer surface 132 of the inner nozzle 116 as allowed by the system. In some embodiments, control or other features may block contact of the outer rim 146 with the tapered outer surface 132 by blocking movement of the nozzle assembly 102, for example of the outer nozzle 112, before such contact occurs. That is, the control or other features may block movement of the outer nozzle 112, for example, once the outer nozzle 112 is at a particular threshold axial position along the longitudinal axis 130.

Figure 6:
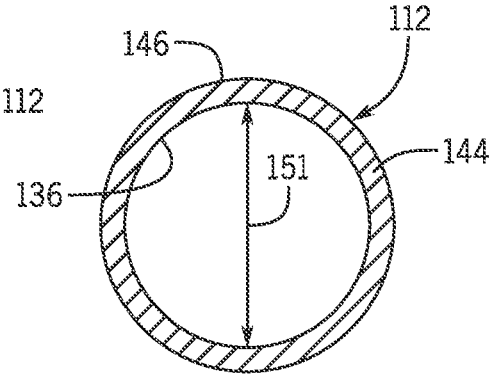
FIG. 6 is a cross-sectional axial view, taken along line 6-6 of FIG. 5, of the nozzle assembly, illustrating an outer outlet of an outer nozzle of the nozzle assembly with a minimum outer outlet area, in accordance with embodiments described herein.
Figure 7:
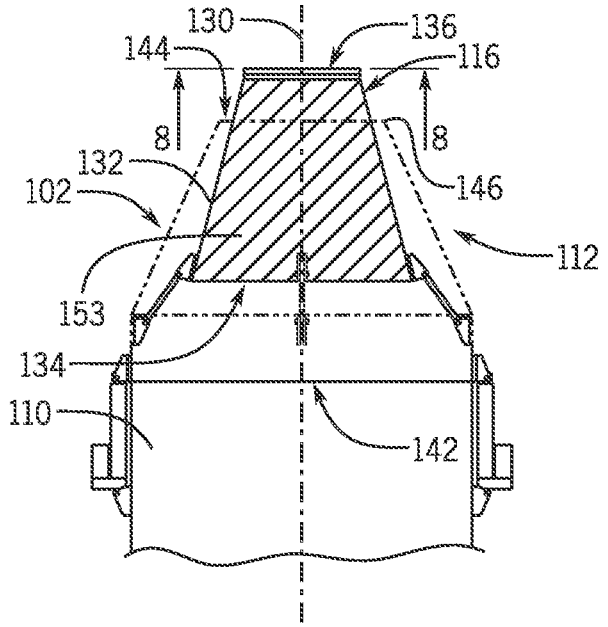
FIG. 7 is a cross-sectional side view of the nozzle assembly of FIG. 5, in accordance with embodiments described herein.
Figure 8:
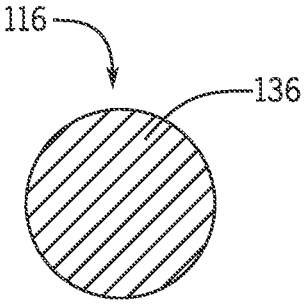
FIG. 8 is a cross-sectional axial view, taken along line 8-8 of FIG. 7, of the nozzle assembly, illustrating an inner outlet area of an inner nozzle of the nozzle assembly, in accordance with embodiments described herein.

FIG. 5 illustrates a cross-sectional side view of the nozzle assembly 102 of FIG. 3, whereby an outer annular flow path 152 of the outer nozzle 112 is defined between the outer nozzle 112, or more particularly a tapered inner surface of the outer nozzle 112, and the tapered outer surface 132 of the inner nozzle 116. The outer annular flow path 152 is cross-hatched in the embodiment illustrated in FIG. 5. FIG. 6 is a cross-sectional axial view, taken along line A-A in FIG. 5, illustrating the outer outlet 144 bounded by the outer rim 146 of the outer nozzle 112 and corresponding to the minimum outlet area or cross-sectional area of the outer outlet 144. In FIG. 6, the outer outlet 144 extends between the outer rim 146 of the outer nozzle 112 and an outer diameter 151 of the tapered outer surface of the inner nozzle 116 (not labeled). FIG. 7 is a cross-sectional side view of the nozzle assembly 102 of FIG. 3, whereby an inner flow path 153 is defined by the inner nozzle 116. While FIGS. 5 and 7 illustrate cross-sections of the nozzle assembly 102 in similar configurations, the outer annular flow path 152 is cross-hatched in FIG. 5 for illustrative purposes, whereas the inner flow path 153 is cross-hatched in FIG. 7 for illustrative purposes. FIG. 8 is a cross-sectional axial, view taken along line 8-8 in FIG. 7, illustrating the inner outlet 136 of the inner nozzle 116.

FIGS. 9-12 illustrate an embodiment of the nozzle assembly 102 of FIG. 3 adjusted to an intermediate outlet area, and in particular an intermediate area of the outer outlet 144. It should be noted that multiple intermediate areas of the outer outlet 144 corresponding to multiple positions of the nozzle assembly 102 are possible, and that the intermediate area of the outer outlet 144 illustrated in FIGS. 9-12 is for descriptive purposes only.

Figure 9:
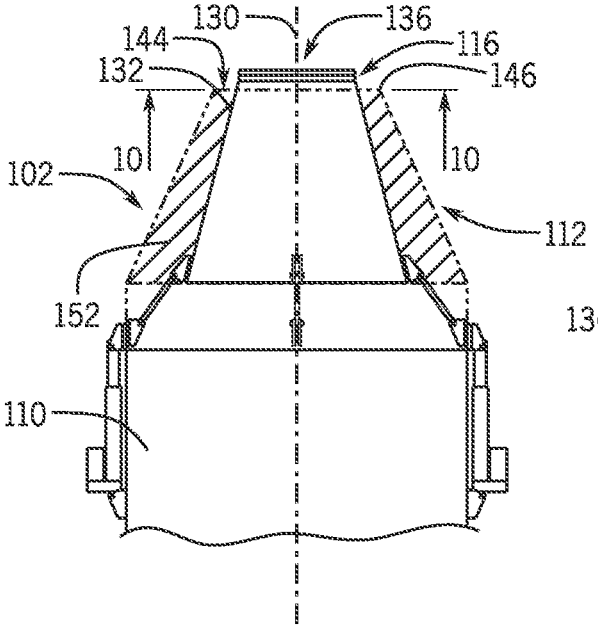
FIG. 9 is a cross-sectional side view of the nozzle assembly of FIG. 3, in accordance with embodiments described herein.
Figure 10:
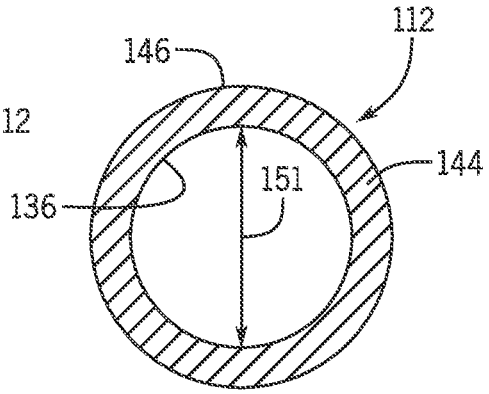
FIG. 10 is a cross-sectional axial view, taken along line 10-10 in FIG. 9, of the nozzle assembly, illustrating an outer outlet of an outer nozzle of the nozzle assembly with an intermediate outer outlet area, in accordance with embodiments described herein.
Figure 11:
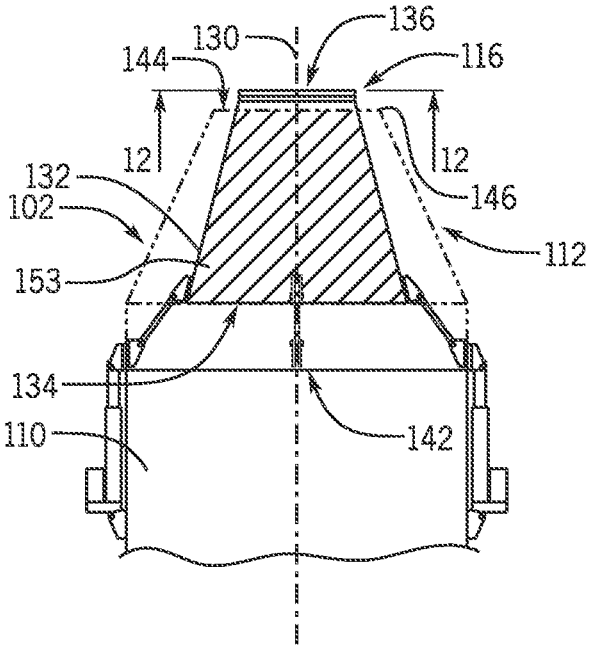
FIG. 11 is a cross-sectional side view of the nozzle assembly of FIG. 9, in accordance with embodiments described herein.
Figure 12:
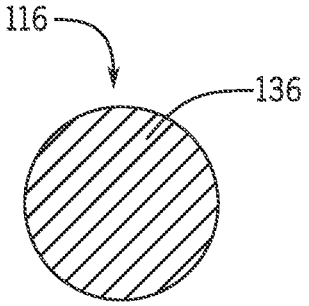
FIG. 12 is a cross-sectional axial view, taken along line 12-12 in FIG. 11, of the nozzle assembly, illustrating an inner outlet area of an inner nozzle of the nozzle assembly, in accordance with embodiments described herein.

Continuing with the illustrated embodiments, FIG. 9 is a cross-sectional side view of the nozzle assembly 102 of FIG. 3, whereby the outer annular flow path 152 of the outer nozzle 112 extends between the outer nozzle 112 and the tapered outer surface 132 of the inner nozzle 116. The outer annular flow path 152 is cross-hatched in the embodiment illustrated in FIG. 9. FIG. 10 is a cross-sectional axial view, taken along line 10-10 in FIG. 9, illustrating the outer outlet 144 extending between the outer rim 146 of the outer nozzle 112 and corresponding to the intermediate outlet area or cross-sectional area, as previously described. In FIG. 10, the outer outlet 144 extends between the outer rim 146 of the outer nozzle 112 and the outer diameter 151 of the tapered outer surface of the inner nozzle 116 (not labeled). FIG. 11 is a cross-sectional side view of the nozzle assembly 102 of FIG. 3, whereby the inner flow path 153 is defined by the inner nozzle 116. While FIGS. 9 and 11 illustrate cross-sections of the nozzle assembly 102 in similar configurations, the outer annular flow path 152 is cross-hatched in FIG. 9 for illustrative purposes, whereas the inner flow path 153 is cross-hatched in FIG. 11 for illustrative purposes. FIG. 12 is a cross-sectional axial view, taken along line 12-12 in FIG. 11, illustrating the inner outlet 136 of the inner nozzle 116.

Figure 13:
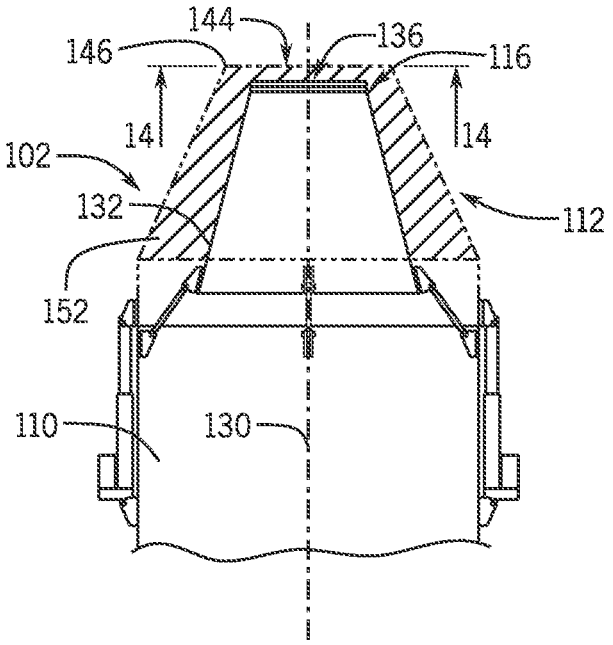
FIG. 13 is a cross-sectional side view of the nozzle assembly of FIG. 3, in accordance with embodiments described herein.
Figure 14:
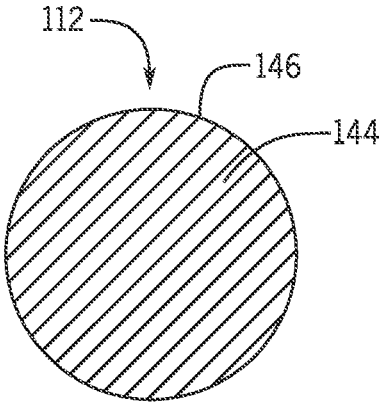
FIG. 14 is a cross-sectional axial view, taken along line 14-14 in FIG. 13, of the nozzle assembly, illustrating an outer outlet of an outer nozzle of the nozzle assembly with a maximum outer outlet size area, in accordance with embodiments described herein.

FIGS. 13-16 illustrate an embodiment of the nozzle assembly 102 of FIG. 3 adjusted to a maximum outlet area or cross-sectional area and in particular a maximum area of the outer outlet 144. It should be noted that the maximum outlet area generally corresponds to a configuration of the nozzle assembly 102 in which the outer outlet 144 of the outer nozzle 112 is positioned axially above or beyond the inner outlet 136 of the inner nozzle 116 relative to the longitudinal axis 130. That is, the maximum outlet area corresponds to a configuration of the nozzle assembly 102 in which a cross-section of the outer outlet 144 is not partially filled or blocked by the inner nozzle 116, as shown in FIG. 14.

Figure 15:
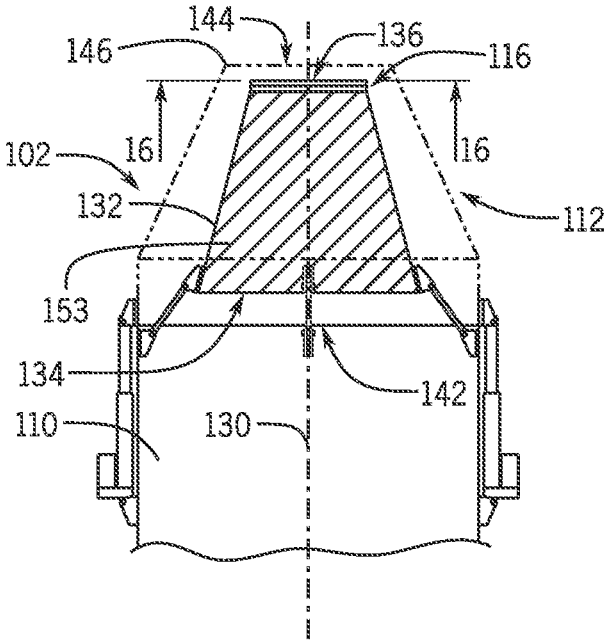
FIG. 15 is a cross-sectional side view of the nozzle assembly of FIG. 13, in accordance with embodiments described herein.
Figure 16:
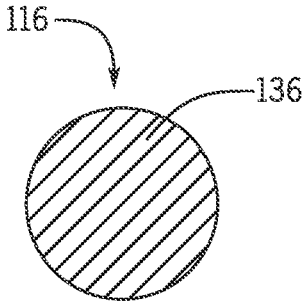
FIG. 16 is a cross-sectional axial view, taken along line 15-15 in FIG. 15, of the nozzle assembly, illustrating an inner outlet area of an inner nozzle of the nozzle assembly, in accordance with embodiments described herein.

Continuing with the illustrated embodiments, FIG. 13 is a cross-sectional side view of the nozzle assembly 102 of FIG. 3, whereby the outer annular flow path 152 of the outer nozzle 112 extends between the outer nozzle 112 and the tapered outer surface 132 of the inner nozzle 116. The outer annular flow path 152 is cross-hatched in the embodiment illustrated in FIG. 13. FIG. 14 is a cross-sectional axial view, taken along line 14-14 in FIG. 13, illustrating the outer outlet 144 extending between the outer rim 146 of the outer nozzle 112 and corresponding to the maximum outlet size or cross-sectional area, as previously described. FIG. 15 is a cross-sectional side view of the nozzle assembly 102 of FIG. 3, whereby the inner flow path 153 is defined by the inner nozzle 116. While FIGS. 13 and 15 illustrate cross-sections of the nozzle assembly 102 in similar configurations, the outer annular flow path 152 is cross-hatched in FIG. 13 for illustrative purposes, whereas the inner flow path 153 is cross-hatched in FIG. 15 for illustrative purposes. FIG. 16 is a cross-sectional axial view, taken along line 16-16 in FIG. 11, illustrating the inner outlet 136 of the inner nozzle 116.

It should be noted that the cross-sectional area of inner outlet 136 of the inner nozzle 116 in FIGS. 5-16 does not change, regardless of the position or configuration of the nozzle assembly 102. That is, with particular focus on FIGS. 8, 12, and 16, the cross-sectional area of the inner outlet 136 of the inner nozzle 116 is substantially constant or equal. However, with particular focus on FIGS. 6, 10, and 14, the cross-sectional area of the outer outlet 144 of the outer nozzle 112 changes as the nozzle assembly 102, for example the outer nozzle 112 of the nozzle assembly 102, is actuated to different axial positions along the longitudinal axis 130. By changing the cross-sectional area of the outer outlet 144 and maintaining the cross-sectional area of the inner outlet 136, a combined cross-sectional area of the inner outlet 136 and the outer outlet 144 is changed. Further, flow characteristics are changed in response to the change in cross-sectional area. As will be appreciated below, the cross-sectional area may be adjusted, for example via the aforementioned adjustment of the position of the outer nozzle 112, in response to operating conditions, such as exhaust demand, thereby improving an efficiency and effectiveness of the nozzle assembly 102 and corresponding exhaust fan unit 100. That is, the nozzle assembly 102 may be adjusted based on a correlation between the exhaust demand and a target combined outlet size, such that the target combined outlet size optimizes velocity of the exhaust fumes expelled from the nozzle assembly 102 and a power input to the fan of the corresponding exhaust fan unit.

Figure 17:
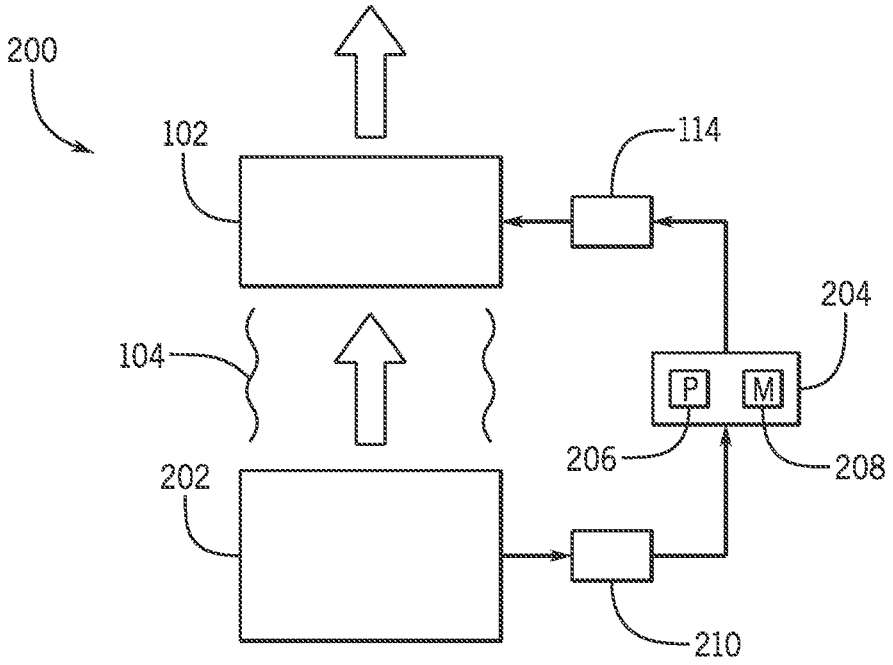
FIG. 17 is a schematic of an exhaust fan unit having control features configured to enable self-adjustments to a nozzle assembly of the exhaust fan unit based on feedback indicative of operating conditions of the exhaust fan unit, in accordance with embodiments described herein.

For example, FIG. 17 is a schematic illustration of an embodiment of an exhaust fan unit 200 having control features configured to enable adjustments to the nozzle assembly 102 of the exhaust fan unit 200, where the adjustments are based on feedback indicative of operating conditions of the exhaust fan unit 200 and/or a corresponding HVAC system 202. As shown, the exhaust fan unit 200 includes a controller 204 having a processor 206 and a memory 208. The memory 208 may include instructions stored thereon that are executable by the processor 206 to cause the controller 204 and/or other control features to perform certain routines. For example, the controller 204 may receive, from a feedback device 210 such as a sensor, data indicative of operating conditions of the HVAC system 202. In one embodiment, the controller 204 may receive data from the feedback device 210 indicative of an exhaust demand of the HVAC system 202 or space being conditioned by the HVAC system 202. "Exhaust demand" may refer to an amount or magnitude of exhaust fumes to be exhausted, for example over a particular period of time.

The controller 204 may then determine, based on the operating exhaust demand, a target outlet size of the nozzle assembly 102, which may be based in part on characteristics of a fan which urges fluid to and through the nozzle assembly 102. For example, the target combined outlet size may be selected in order to achieve a desired velocity of the exhaust fumes from the nozzle assembly 102 and/or to reduce a power input to the fan of the corresponding exhaust fan unit 200. After determining the target outlet size, the controller 204 may instruct an actuator 114 or intervening component to adjust a condition or configuration of the nozzle assembly 102 in response to the exhaust demand. For example, as previously described, a position of the outer nozzle 112 of the nozzle assembly 102 may be adjustable to adapt or adjust a cumulative outlet size of the nozzle assembly 102. That is, the outer nozzle 112 of the nozzle assembly 102 may be moved such that the total outlet size of the nozzle assembly 102 corresponds to the exhaust demand. In other embodiments, a positon of the inner nozzle 116 of the nozzle assembly 102 may be additionally or alternatively adjustable. An algorithm, which may be stored to the memory 208 of the controller 204, may be executed to determine the ideal position or configuration of the nozzle assembly 102, as a means to enable the desired size of the outlet(s) thereof, based on the exhaust demand. For example, a relatively large exhaust demand may correspond to a larger outlet size of the nozzle assembly 102, whereas a relatively small exhaust demand may correspond to a smaller outlet size of the nozzle assembly 102. The correlation between the exhaust demand and the outlet size may be, for example, a linear correlation, logarithmic correlation, exponential correlation, or some other correlation determined empirically or in another manner.

Figure 18:
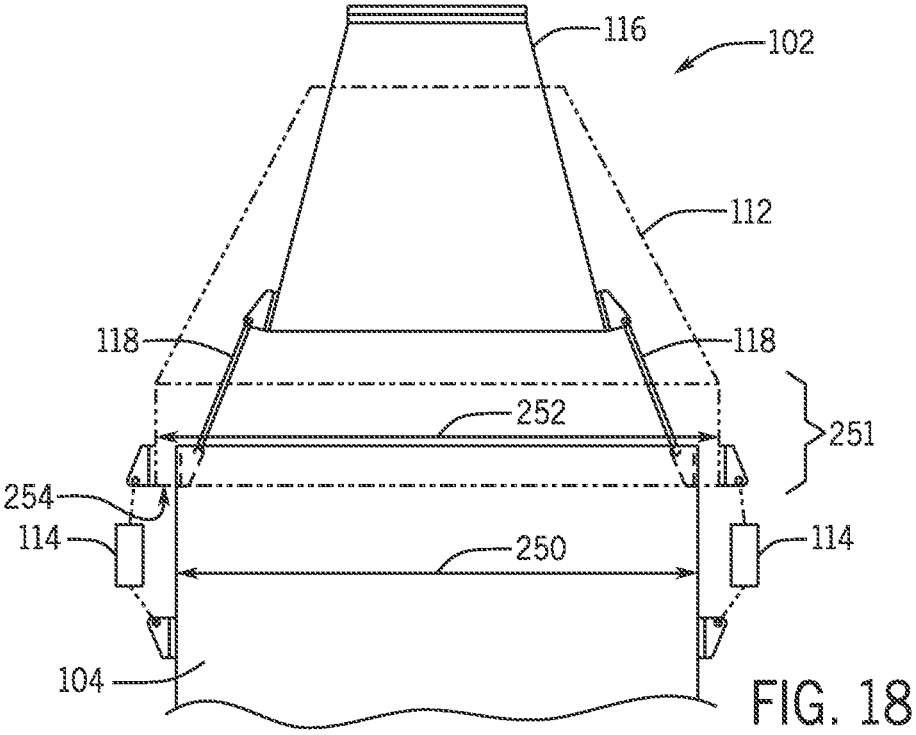
FIG. 18 is a cross-sectional side view of a nozzle assembly of an exhaust fan unit, in accordance with embodiments described herein.

In some embodiments, the outer nozzle 112 of the nozzle assembly 102 may be adjustable to adjust the cumulative outlet size of the nozzle assembly 102. In some embodiments, the inner nozzle 116 of the nozzle assembly 102 may be adjustable to adjust the cumulative outlet size of the nozzle assembly 102. For example, FIG. 18 illustrates an embodiment of the nozzle assembly 102 in which the actuators 114 are coupled between the base 104, such as a spacer or extender tube of the base 104, and the outer nozzle 112. The inner nozzle 116 may be coupled to the base 104 via the stabilizing legs 118. Thus, the inner nozzle 116 is maintained in a particular position relative to the base 104, and the outer nozzle 112 is moved by the actuators 114 relative to the base 104 and the inner nozzle 116.

Figure 19:
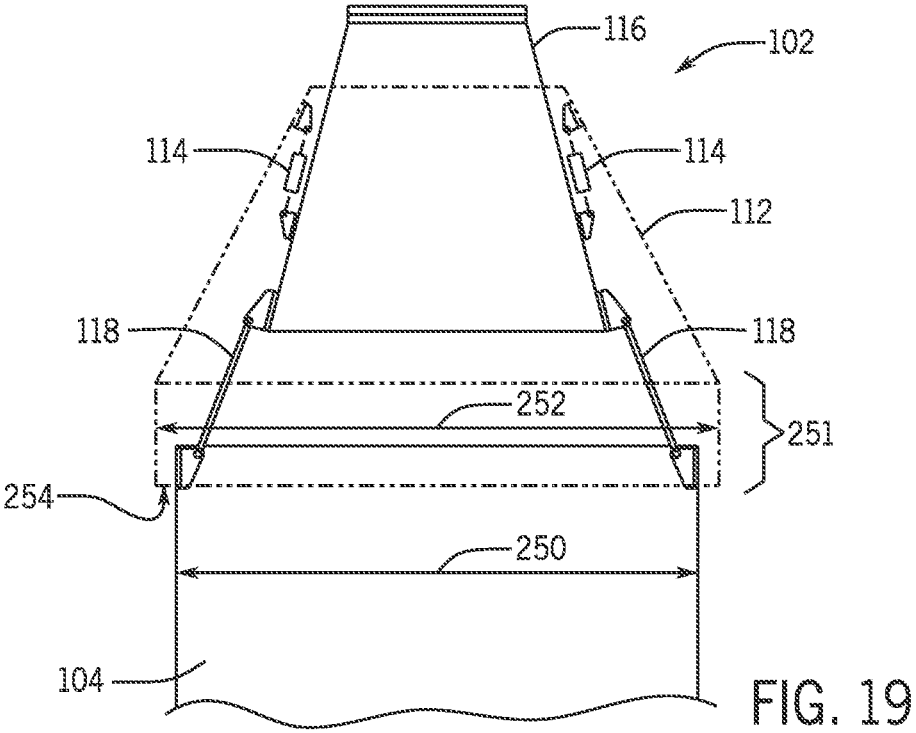
FIG. 19 is a cross-sectional side view of a nozzle assembly of an exhaust fan unit, in accordance with embodiments described herein.

FIG. 19 illustrates an embodiment of the nozzle assembly 102 in which the actuators 114 are coupled between the inner nozzle 116 and the outer nozzle 112. The inner nozzle 116 may be coupled to the base 104 via the stabilizing legs 118. The outer nozzle 112 may not be rigidly attached to the base 104. Thus, the inner nozzle 116 is maintained in a particular position relative to the base 104, and the outer nozzle 112 is moved by the actuators 114 relative to the base 104 and the inner nozzle 116. However, it should be noted that, in another embodiment in which the actuators 114 are coupled to the inner nozzle 116 and to the outer nozzle 112, the illustrated stabilizing legs 118 may be coupled to the base 104 and to the outer nozzle 112, instead of the inner nozzle 116, such that the outer nozzle 112 is maintained in a particular position relative to the base 104, and the inner nozzle 116 is moved by the actuators 114 relative to the base 104 and the outer nozzle 112.

Figure 20:
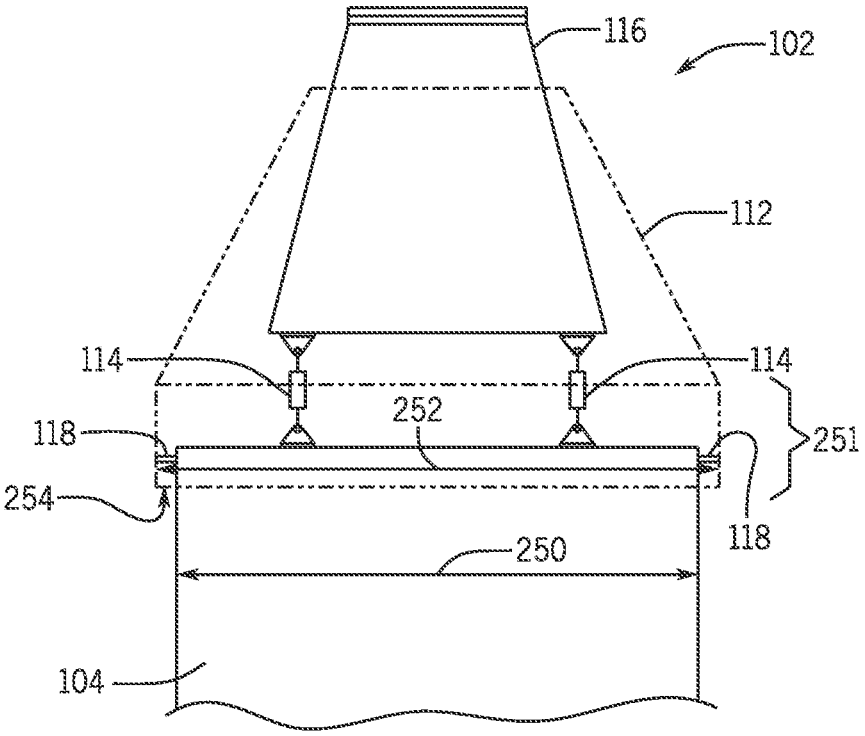
FIG. 20 is a cross-sectional side view of a nozzle assembly of an exhaust fan unit, in accordance with embodiments described herein.

FIG. 20 illustrates an embodiment of the nozzle assembly 102 in which the actuators 114 are coupled between the inner nozzle 116 and the base 104. The outer nozzle 112 may be coupled to the base 104 via the stabilizing legs 118. The inner nozzle 116 may not be rigidly attached to the base 104. Thus, the outer nozzle 112 is maintained in a particular position relative to the base 104, and the inner nozzle 116 is moved by the actuators 114 relative to the base 104 and the outer nozzle 112.

In each of FIGS. 18-20, the outer nozzle 112 may include a larger inner diameter 252 than an outer diameter 250 of the base 104 (or spacer thereof). For example, the outer nozzle 112 may include a skirt 251 whereby the inner diameter 252 is constant. Thus, an air gap 254 may extend between the skirt 251 of the outer nozzle 112 and the base 104. As exhaust fumes are passed from the base 104 (or spacer thereof) to the nozzle assembly 102, a Venturi effect may be created which draws air into the air gap 254. The air from the air gap 254 may mix with the exhaust fumes, which may improve aspects relating to operation of the exhaust fan unit, such as velocity of the flow therefrom, distribution of the fumes and contents thereof, and/or power consumption and efficiency.

Further, it should be noted that other connections between the base 104 and the nozzle assembly 102 are also possible. For example, in one embodiment, the nozzle assembly 102 may not be stabilized against the base 104. Instead, the outer nozzle 112 and the inner nozzle 116 may be coupled together via one or more actuators 114, such that the inner nozzle 116 can be moved relative to the outer nozzle 112, and one of the inner nozzle 116 or the outer nozzle 112 may be coupled to the base 104 via one or more actuators 114, such that the nozzle assembly 102 can be moved as a whole relative to the base 104.

Figure 21:
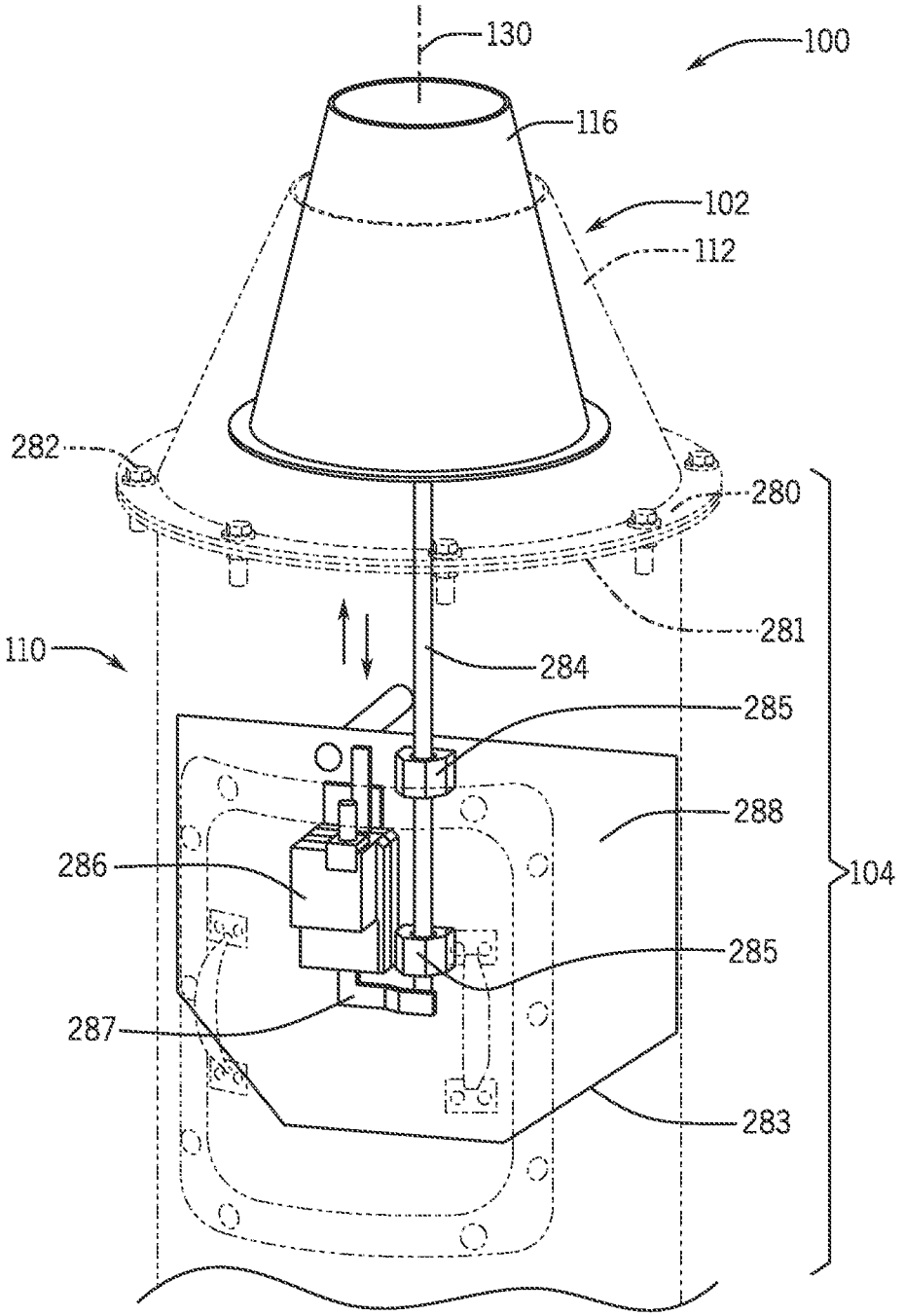
FIG. 21 is a perspective view of an exhaust fan unit for use in the HVAC system of FIG. 1, in accordance with embodiments described herein.

The presently disclosed exhaust fan unit may include other embodiments in which the inner nozzle 116 is movable relative to the outer nozzle 112 and the base of the exhaust fan unit. For example, FIG. 21 is a perspective view of an embodiment of the exhaust fan unit 100 for use in the HVAC system of FIG. 1. In the illustrated embodiment, the outer nozzle 112 and the extender tube 110 may be directly coupled such that there is not an air gap therebetween. For example, as shown, the outer nozzle 112 includes a flange 280, the extender tube 110 includes a flange 281, and the flanges 280, 281 are coupled via fastener assemblies 282, such as nuts and bolts, although other fastener assemblies or coupling mechanisms may be used in accordance with the present disclosure. The inner nozzle 116 may be movable relative to the outer nozzle 112 and the extender tube 110 via an inner nozzle actuation assembly 290. A perspective view of an embodiment of the inner nozzle actuation assembly 290, and the inner nozzle 116, is illustrated in FIG. 22.

Figure 22:
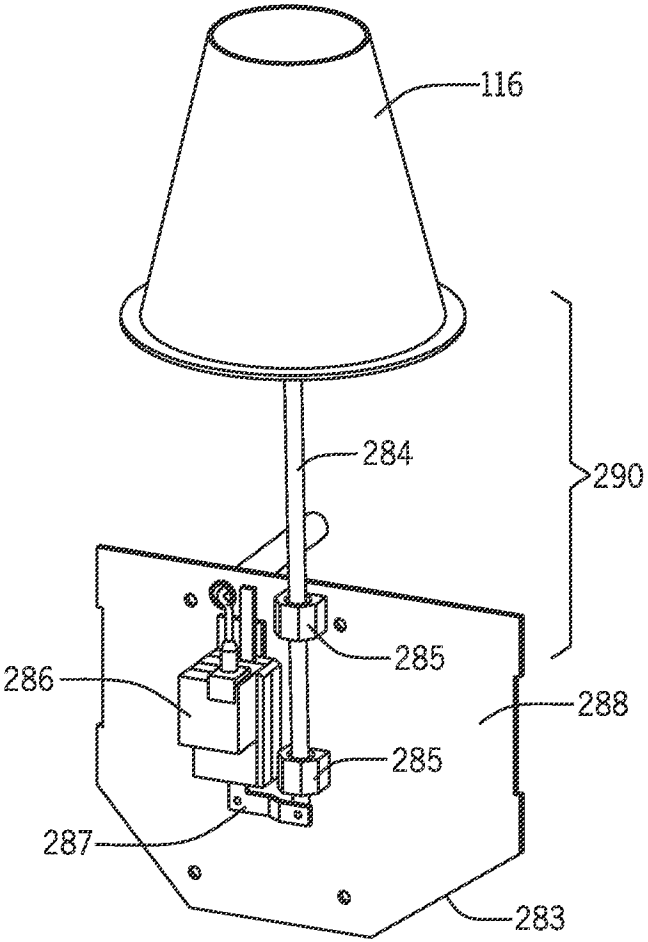
FIG. 22 is a perspective view of an inner nozzle and an inner nozzle actuation assembly for use in the exhaust fan unit of FIG. 21, in accordance with embodiments described herein.

In FIGS. 21 and 22, the inner nozzle actuation assembly 290 includes a mounting plate 283 disposed within the extender tube 110 and having a thin profile relative to the air flow through the extender tube 110 along the longitudinal axis 130. The mounting plate 283 includes a liner actuator 286 mounted thereon, as well as one or more bearings 285. While two bearings 285 are shown on the mounting plate 283 in the illustrated embodiment, a different number of bearings 285 may be utilized in another embodiment. A support shaft 284 may extend through openings in the bearings 285, and may couple with the linear actuator 286 via connector 287, and with the inner nozzle 116 via features illustrated in, and described with respect to, FIG. 23. Thus, as the linear actuator 286 causes the support shaft 284 to move linearly, for example along the longitudinal axis 130, the support shaft 284 causes the inner nozzle 116 to move linearly relative to the outer nozzle 112 and the extender tube 110. An access door 288 on the cylindrical extender tube 110 may facilitate access to the inner nozzle actuation assembly 290 for maintenance and other purposes.

Figure 23:
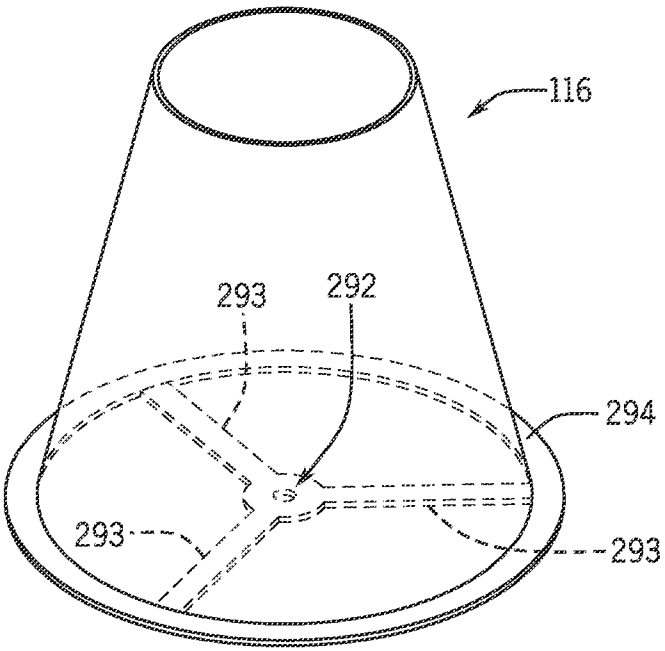
FIG. 23 is a perspective view of an inner nozzle for use in the exhaust fan unit of FIG. 21, in accordance with embodiments described herein.

FIG. 23 is a perspective view of an embodiment of the inner nozzle 116 for use in the exhaust fan unit 100 of FIG. 21. As previously described, the inner nozzle 116 includes the inner inlet 134 for receiving an air flow. As shown, arms 293 of the inner nozzle 116 may extend through, or adjacent to, the inner inlet 134. The arms 293 may connect and include a shaft opening 293 configured to receive the support shaft 284 illustrated in, and described above with respect to, FIGS. 21 and 22. That is, the support shaft 284 may couple to the inner nozzle 116, as previously described, at or adjacent to the shaft opening 293. In some embodiments, a fastener may extend through the shaft opening 292 and couple to the support shaft 284. In other embodiments, the support shaft 284 may extend through the shaft opening 292 and couple to a fastener.

Figure 24:
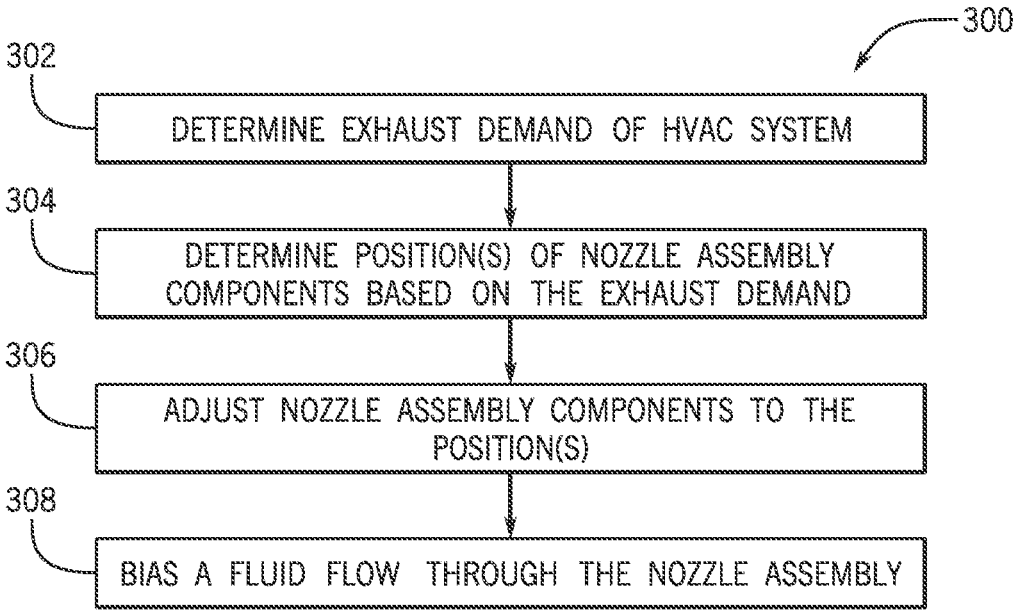
FIG. 24 is a flow chart of a method of operating the exhaust fan unit of FIG. 17, in accordance with embodiments described herein.

FIG. 24 illustrates an embodiment of a method 300 of operating the exhaust fan unit of FIG. 17. For example, the method 300 includes determining (block 302) an exhaust demand of the HVAC system. As previously described, "exhaust demand" may refer to a magnitude or amount of exhaust fumes to be exhausted by the exhaust fan unit, for example over a particular period of time. A controller of the exhaust fan unit, or an HVAC system unit controller, may determine the exhaust demand based on, for example, sensor feedback.

The method 300 also includes determining (block 304) one or more positions of components of a nozzle assembly of the exhaust fan unit based on the exhaust demand. As previously described, the nozzle assembly may include an inner nozzle and an outer nozzle, and a position of at least one of the inner nozzle or the outer nozzle may be adjustable to change outlet sizes of the nozzle assembly, as previously described. After determining the desired or target position(s) of the inner nozzle and/or outer nozzle, the method 300 may include adjusting (block 306) one or more nozzle assembly components to the determined position(s).

The method 300 also includes biasing or forcing (block 308) a fluid flow through the nozzle assembly. For example, the exhaust fan unit may include a fan which draws the exhaust fumes into the exhaust fan unit from a duct of the HVAC system. The fan may also urge the exhaust fumes through the nozzle assembly, which ejects the exhaust fumes to a surrounding environment.

In accordance with the present disclosure, an adjustable nozzle assembly of an exhaust fan unit may facilitate an adaptable outlet size or cross-sectional area of the nozzle assembly based on operating conditions, such as exhaust demand, of an HVAC system or corresponding conditioned space. By adjusting the nozzle assembly as presently disclosed, power consumption of the exhaust fan unit may be improved, and a distribution of exhaust fumes may be improved. Thus, presently disclosed nozzle assemblies may improve an efficiency of the exhaust fan unit, and may reduce an environmental impact of the exhaust fan unit on surrounding environments.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A fan unit, comprising:

an inner nozzle having an inner nozzle outlet configured to expel, toward an environment and from a base of the fan unit, a first fluid exhaust flow via an inner nozzle flow path defined by the inner nozzle;

an outer nozzle disposed about the inner nozzle and having an outer nozzle outlet configured to expel, toward the environment and from the base of the fan unit, a second fluid exhaust flow via an outer nozzle annular flow path defined between an interior of the outer nozzle and an exterior of the inner nozzle, wherein the inner nozzle fluidly separates at least a portion of the inner nozzle flow path from at least a portion of the outer nozzle annular flow path; and a controller configured to control a longitudinal movement of the inner nozzle, the outer nozzle, or both based on an operating condition associated with the fan unit.

2. The fan unit of claim 1, wherein the controller is configured to receive data indicative of the operating condition associated with the fan unit from a sensor configured to detect the operating condition associated with the fan unit.

3. The fan unit of claim 1, wherein the controller is configured to control the longitudinal movement of the inner nozzle, the outer nozzle, or both based on an exhaust demand corresponding to the operating condition.

4. The fan unit of claim 1, wherein the exterior of the inner nozzle comprises a tapered outer surface and the outer nozzle annular flow path is defined between the interior of the outer nozzle and the tapered outer surface.

5. The fan unit of claim 4, wherein the interior of the outer nozzle comprises a tapered inner surface and the outer nozzle annular flow path is defined between the tapered inner surface of the outer nozzle and the tapered outer surface of the inner nozzle.

6. The fan unit of claim 5, wherein the tapered outer surface of the inner nozzle is tapered at a first angle relative to a longitudinal axis of the fan unit, the tapered inner surface of the outer nozzle is tapered at a second angle relative to the longitudinal axis of the fan unit, and the second angle is greater than the first angle.

7. The fan unit of claim 1, wherein the controller is configured to control the longitudinal movement of the inner nozzle, the outer nozzle, or both such that a cross-sectional area of the outer nozzle outlet changes in response to the longitudinal movement of the inner nozzle, the outer nozzle, or both.

8. The fan unit of claim 1, wherein the controller is configured to control the longitudinal movement of the inner nozzle relative to the outer nozzle and based on the operating condition associated with the fan unit.

9. The fan unit of claim 1, comprising at least one fan configured to:

bias the first fluid exhaust flow through the inner nozzle flow path, through the inner nozzle outlet, and toward the environment; and bias the second fluid exhaust flow through the outer nozzle annular flow path, through the outer nozzle outlet, and toward the environment.

10. One or more tangible, non-transitory, computer-readable media storing instructions thereon that, when executed by one or more processors, are configured to cause the one or more processors to:

receive data indicative of an operating condition of a fan unit; and control, based on the data indicative of the operating condition, longitudinal movement of an inner nozzle of the fan unit or an outer nozzle of the fan unit, wherein:

the inner nozzle includes an inner nozzle outlet configured to expel, toward an environment and from a base of the fan unit, a first fluid exhaust flow via an inner nozzle flow path defined by and inwards from a frusto-conical shape of the inner nozzle;

the outer nozzle includes an outer nozzle outlet configured to expel, toward the environment and from the base of the fan unit, a second fluid exhaust flow via an outer nozzle annular flow path defined between the outer nozzle and the frusto-conical shape of the inner nozzle; and the longitudinal movement of the inner nozzle of the fan unit or the outer nozzle of the fan unit causes a change to a cross-sectional area of the outer nozzle annular flow path, the outer nozzle outlet, or both.

11. The one or more tangible, non-transitory, computer-readable media of claim 10, wherein the instructions, when executed by the one or more processors, are configured to cause the one or more processors to receive the data indicative of the operating condition of the fan unit from a sensor configured to detect the operating condition of the fan unit.

12. The one or more tangible, non-transitory, computer-readable media of claim 10, wherein the instructions, when executed by the one or more processors, are configured to cause the one or more processors to receive the data indicative of an exhaust demand corresponding to the operating condition of the fan unit.

* * * * *